US007748537B1

(12) United States Patent
Manger

(10) Patent No.: US 7,748,537 B1
(45) Date of Patent: Jul. 6, 2010

(54) LAZY SUSAN TRAY INSERT

(76) Inventor: Dawn Manger, 890 High Mountain Rd., North Haledon, NJ (US) 07508

( * ) Notice: Subject to any disclaimer, the term of this patent is extended or adjusted under 35 U.S.C. 154(b) by 81 days.

(21) Appl. No.: 12/211,722

(22) Filed: Sep. 16, 2008

(51) Int. Cl.
*A47B 11/00* (2006.01)
*B65D 1/34* (2006.01)

(52) U.S. Cl. ..... 206/557; 108/14; 108/103; 211/131.1; 211/78

(58) Field of Classification Search ..... 108/14, 108/103, 11, 16; 211/131.1, 78, 71.01, 107, 211/49.01, 59.4, 126.1; 206/557, 558, 561, 206/564, 565
See application file for complete search history.

(56) References Cited

U.S. PATENT DOCUMENTS 5,335,803 A 8/1994 O'Brien et al.
6,099,609 A * 8/2000 Lira et al. ..... 55/400
6,477,966 B1 11/2002 Petryna
6,837,386 B1 1/2005 Kent et al.
7,225,633 B2 * 6/2007 DeMars ..... 62/457.6
2003/0172671 A1 * 9/2003 DeMars ..... 62/457.2
2005/0005631 A1 * 1/2005 DeMars ..... 62/457.6
2005/0076817 A1 * 4/2005 Boks et al. ..... 108/103
2008/0134551 A1 * 6/2008 Conforti et al. ..... 40/506

* cited by examiner

*Primary Examiner*—Jacob K Ackun, Jr.
(74) *Attorney, Agent, or Firm*—Crossley Patent Law; Mark A. Crossley

(57) ABSTRACT

A removable insert for Lazy Susan type rotatable tray having a base with a continuous side wall, the base supported by a vertical support post. The insert is wedge-shaped and has a curved contour for engaging the tray post and side wall. The insert has a raised perimeter, a variety of optional flat bottom walls with non-slip feet at each corner. The bottom wall may be solid or have circular cutouts having a diameter of about 2½ inches to fit a beverage can bottom end. A lid is provided to fit the raised perimeter. A shelf with attached legs permits stacking of inserts. The insert holds items, such as beverage cans, jars, and canned goods, upright and organized and permits tray spinning for item access without spilling or knocking over the items. The present device is durable, space-saving, and reasonably priced.

9 Claims, 4 Drawing Sheets

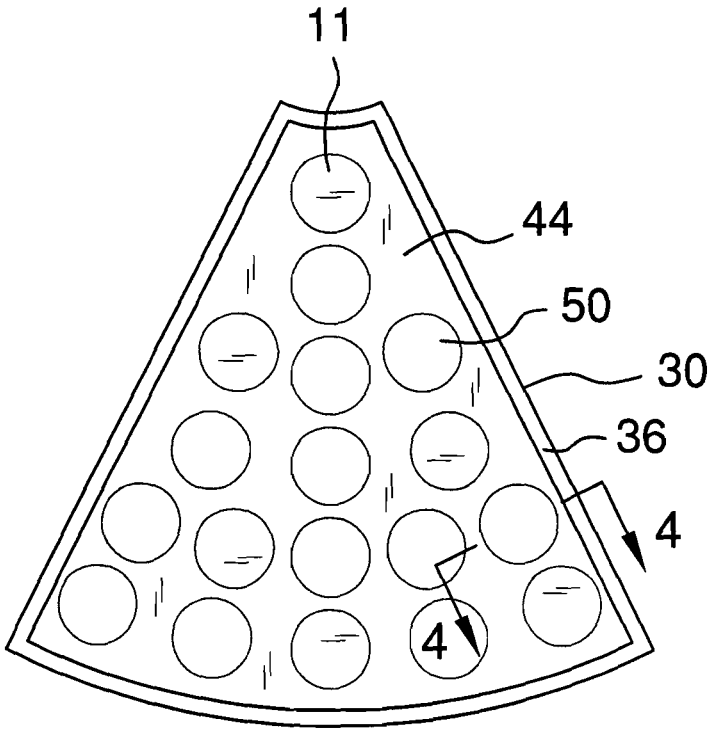
FIG. 3
FIG. 4
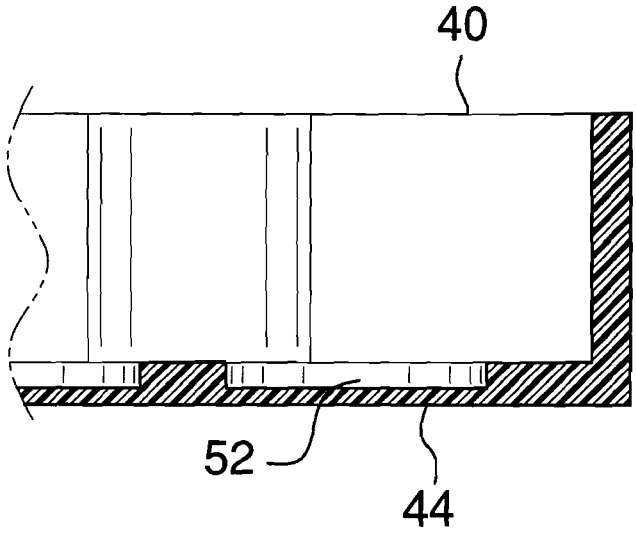

LAZY SUSAN TRAY INSERT

BACKGROUND OF THE INVENTION

Various food containers, including rotatable trays, with removable components and compartments, have been developed in the past. However, what is needed is a removable insert for a Lazy Susan type rotatable tray having a base with a continuous side wall, the base supported by a vertical support post, the insert having a substantially wedge-shaped, curved contour to engage the tray base, post, and side wall and further having a raised perimeter, and a variety of optional bottom walls having optional non-slip feet, a lid, and a shelf which has corner legs for stacking the inserts.

SUMMARY OF THE INVENTION

The present Lazy Susan tray insert provides a removable insert for a Lazy Susan type rotatable tray having a base with a continuous side wall, the base supported by a vertical support post. The insert has a substantially wedge-shaped, curved contour for engaging the tray post and the tray side wall and further has a raised perimeter, a variety of optional flat bottom walls with optional non-slip feet. A bottom wall may provide a plurality of circular cutouts having a 2%-inch diameter, thus sized to accommodate a beverage can. A lid may be provided which covers the insert. A shelf having corner legs may also be provided to permit stacking of inserts. The insert is designed to keep items, such as canned goods and jars, stored thereon in an upright position and to spin the Lazy Susan tray to conveniently and easily access a particular item stored thereon without spilling or knocking over the items. The present device is space-saving and assists in kitchen organization and, in addition, is durable, and reasonably priced.

As such, the general purpose of the improved Lazy Susan tray insert which has all of the advantages of the prior art mentioned heretofore and many novel features that result in an improved Lazy Susan tray insert which is not anticipated, rendered obvious, suggested, or even implied by the prior art, either alone or in combination thereof.

Thus has been broadly outlined the more important features of the improved Lazy Susan tray insert so that the detailed description thereof that follows may be better understood and in order that the present contribution to the art may be better appreciated.

The objects, features and advantages of the improved Lazy Susan tray insert will be readily apparent to those of ordinary skill in the art upon reading the following detailed description of presently preferred, but nonetheless illustrative, embodiments of the improved Lazy Susan tray insert when taken in conjunction with the accompanying drawings. In this respect, before explaining the current embodiments of the improved Lazy Susan tray insert in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the concept of this disclosure may be readily utilized as a basis for the design of other structures, methods, and apparatus for carrying out the several purposes of the improved Lazy Susan tray insert. It is therefore important that the claims be regarded as including such equivalent constructions insofar as they do not depart from the spirit and scope of the present invention.

Objects of the improved Lazy Susan tray insert, along with various novel features that characterize the invention are particularly pointed out in the claims forming a part of this disclosure. For better understanding of the improved Lazy Susan tray insert, its operating advantages and specific objects attained by its uses, refer to the accompanying drawings and description.

BRIEF DESCRIPTION OF THE DRAWINGS

FIG. 3 is a bottom plan view of another embodiment providing cutouts.

FIG. 4 is a cross-sectional view taken along line 4-4 of FIG. 3.

DETAILED DESCRIPTION OF THE DRAWINGS

Figure 1:
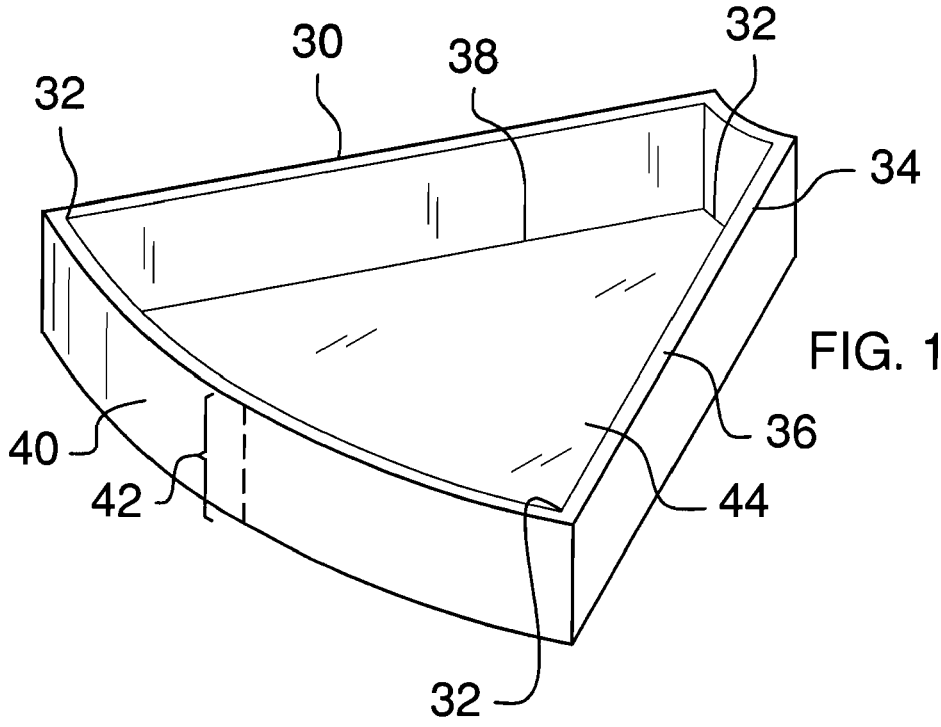
FIG. 1 is a top isometric view of an embodiment having a flat bottom.
Figure 2:
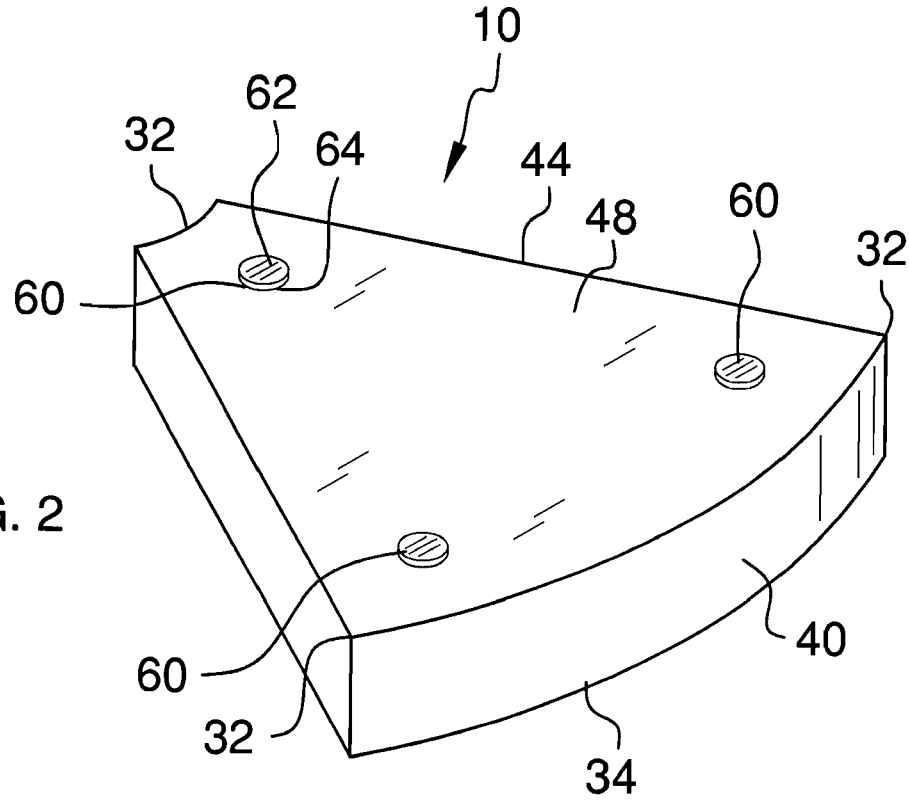
FIG. 2 is a bottom isometric view of the embodiment of FIG. 1.
Figure 5:
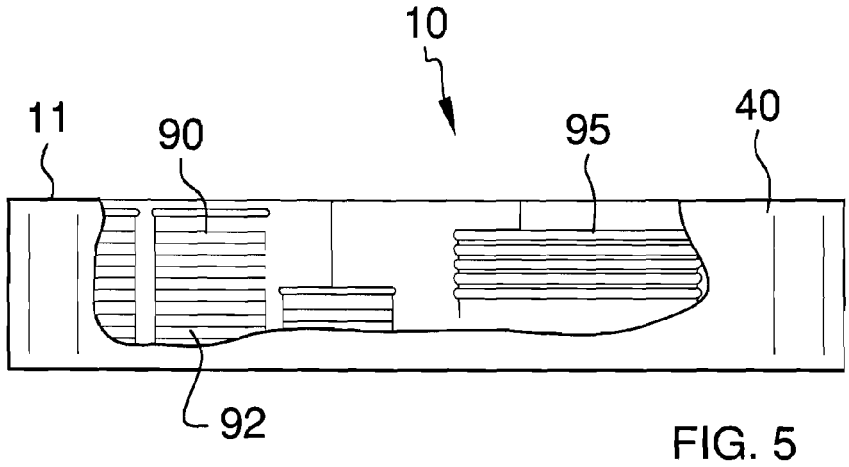
FIG. 5 is an in-use front elevation of the embodiment of FIG. 1 with a cutaway view.
Figure 6:
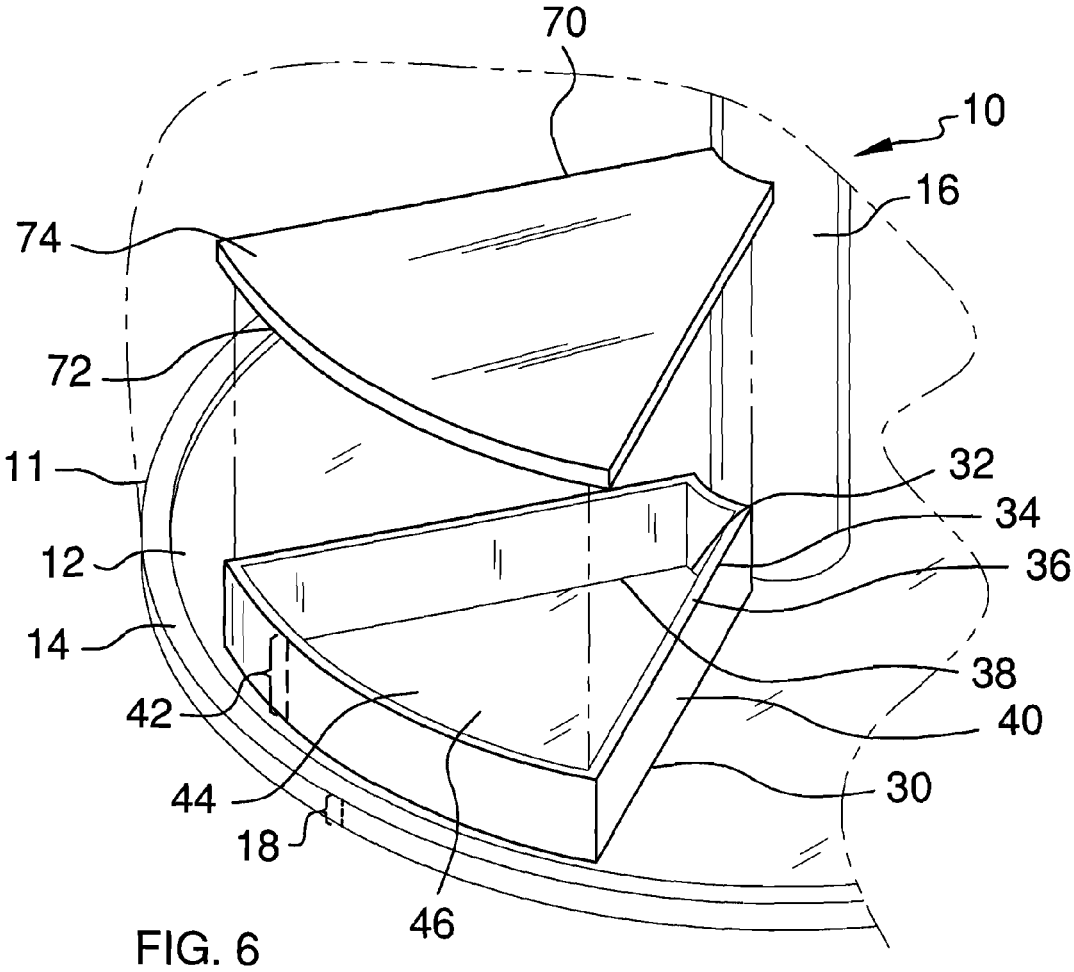
FIG. 6 is an isometric view of the embodiment of FIG. 1.
Figure 7:
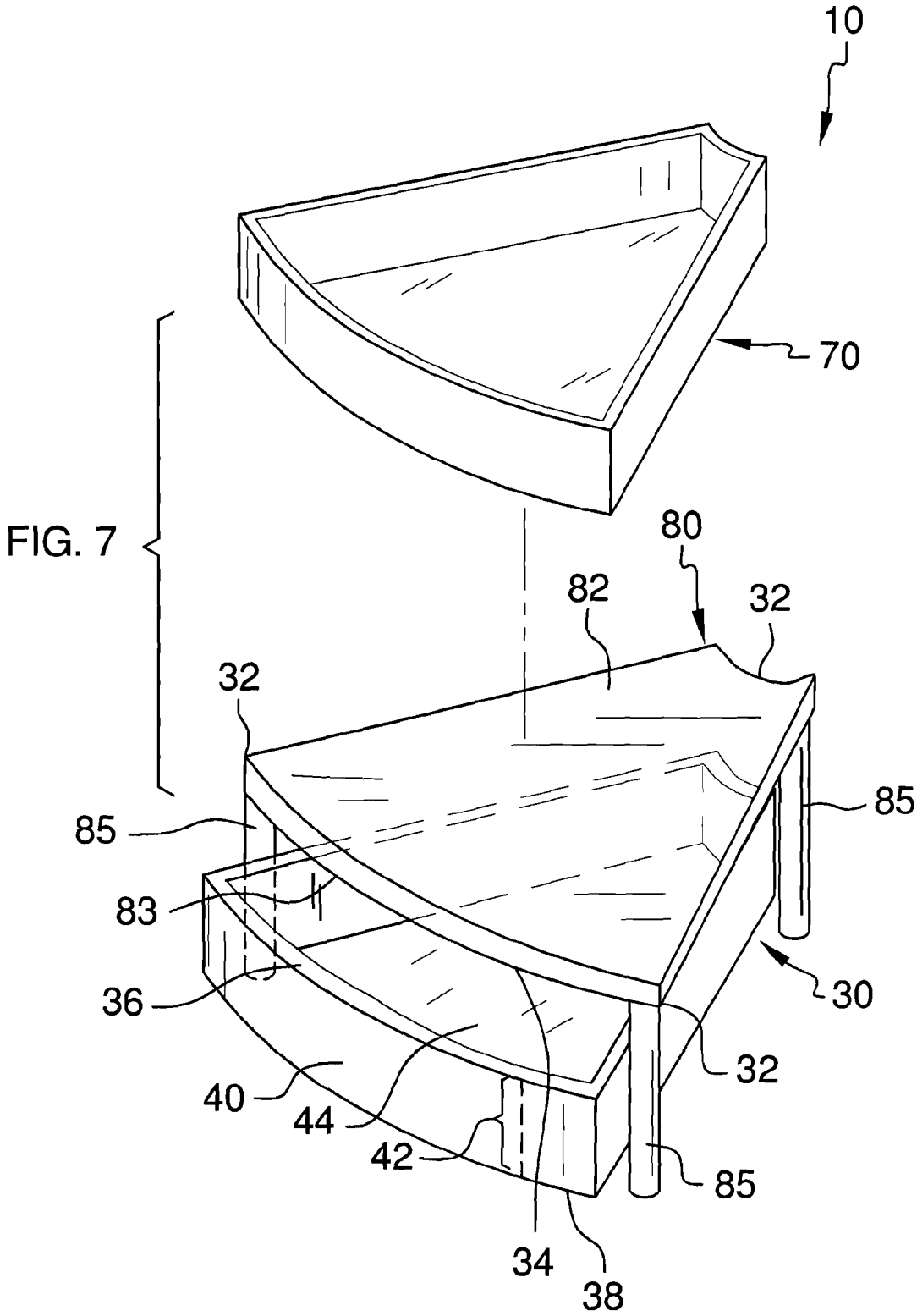
FIG. 7 is an isometric view of still another embodiment providing a shelf.

With reference now to the drawings, and in particular FIGS. 1 through 7 thereof, examples of the employing the principles and concepts of the present Lazy Susan tray insert, generally designated by the reference number 10, will be described.

Referring to FIGS. 1 through 7, the present Lazy Susan tray insert 10 provides a Lazy Susan type rotatable tray 11 having a base 12 with a continuous side wall 14, the base 12 supported by a vertical support post 16, the side wall 14 having a first height 18. A removable substantially wedge-shaped insert 30 is provided. The insert 30 has a curved contour. The insert 30 has three opposing corners 32. The insert 30 provides a raised perimeter 34 and a solid flat bottom wall 44. The raised perimeter 34 has a top edge 36, a bottom edge 38, and continuous side edge 40. The side edge 40 has a second height 42 slightly greater than the tray 11 side wall 14 first height 18, the insert removably engaging the base 12, the support post 16, and the tray 11 side wall 14. The bottom wall 44 has an interior surface 46 and an exterior surface 48. The bottom wall 44 conforms to and is permanently attached to the perimeter 34 bottom edge 38. Instead of being solid, the bottom wall 44 may have plurality of circular cutouts 50 therethrough and a continuous recessed wall 52 corresponding to each cutout 50, the recessed wall 52 having a diameter equal to the cutout diameter and extending vertically downwardly slighting below the interior surface. The cutouts 50 have a diameter of about 2½ inches to permit a beverage can 90 bottom portion 92 to removably snuggly fit therein. The bottom wall may also have a non-slip foot 60 at each corner 32. A lid 70 may also be provided. The lid 70 has an interior side 72 and an exterior side 74. The lid 70 conforms to the size and dimensions of the perimeter 34 top edge 36 and is removably attached to the perimeter 34 top edge 36. A shelf 80 may also be provided. The shelf 80 has the same shape as the insert 30, has three corners 32, and is slightly wider and longer than the insert 30. The shelf 80 has an upper side 82 and a lower side 83. An identical leg 85 is permanently attached to and extends downwardly from each corner of the shelf 80 lower side 83.

The insert 30 holds miscellaneous items 95, such as beverage cans 90, jars, and canned goods, upright and organized and permits tray 11 spinning for item 95 access without spilling or knocking over the items 95. The present device 10 is durable, space-saving, and reasonably priced.

With respect to the above description then, it is to be realized that the optimum dimensional relationships for the parts of the present apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A Lazy Susan tray insert comprising, in combination:

a Lazy Susan type rotatable tray having a base with a continuous side wall, the base supported by a vertical support post, the side wall having a first height;

at least one removable substantially wedge-shaped insert having a curved contour and three opposing corners, the insert comprising:

a raised perimeter having a top edge, a bottom edge, and continuous side edge, the side edge having a second height greater than the tray side wall first height, the insert removably engaging the base, the support post, and the tray side wall;

a solid flat bottom wall conforming to and permanently attached to the perimeter bottom edge, the bottom wall comprising an interior surface and an exterior surface having a non-slip foot at each corner; and a lid having an interior side and an exterior side, the lid conforming to the size and dimensions of the perimeter top edge and removably attached to the insert perimeter top edge.

2. The Lazy Susan tray insert of claim 1 wherein the foot comprises a first side removably affixed to the bottom wall exterior surface and an opposing second side comprising a non-slip material.

3. The Lazy Susan tray insert of claim 1 wherein the foot comprises a first side permanently affixed to the bottom wall exterior surface and an opposing second side comprising a non-slip material.

4. The Lazy Susan tray insert of claim 1 further comprising a shelf slightly wider and longer than the insert and having the same shape as the insert, the shelf comprising:

an upper side;

a lower side;

an identical leg permanently attached to and extending downwardly from each corner of the shelf lower side, each leg slightly longer than the second height of the insert raised perimeter, wherein the legs permit the stacking of the inserts.

5. A Lazy Susan tray insert comprising, in combination:

a Lazy Susan type rotatable tray having a base with a continuous side wall, the base supported by a vertical support post, the side wall having a first height;

at least one removable substantially wedge-shaped insert having a curved contour and three opposing corners, the insert comprising a raised perimeter having a top edge, a bottom edge and a continuous side edge, the side edge having a second height slightly greater than the first height, the insert removably engaging the base, the support post, and the tray side wall; and a bottom wall conforming to and permanently affixed to the perimeter bottom edge, the bottom wall comprising an exterior surface, a flat interior surface having a plurality of cutouts therethrough, each cutout having a diameter of about 2½ inches, and a continuous recessed wall corresponding to each cutout, the recessed wall having a diameter equal to the cutout and extending vertically downwardly slightly below the interior surface.

6. The Lazy Susan tray insert of claim 5 further comprising a non-slip foot attached to the bottom wall exterior surface at each corner, the foot comprising a first side removably affixed to the bottom wall exterior surface and an opposing second side comprising a non-slip material.

7. The Lazy Susan tray insert of claim 5 further comprising a non-slip foot attached to the bottom wall exterior surface at each corner, the foot comprising a first side permanently affixed to the bottom wall exterior surface and an opposing second side comprising a non-slip material.

8. The Lazy Susan tray insert of claim 5 further comprising a shelf slightly wider and longer than the insert and having the same shape as the insert, the shelf comprising:

an upper side;

a lower side;

an identical leg permanently attached to and extending downwardly from each corner of the shelf lower side, each leg slightly longer than the second height of the raise perimeter, wherein the legs permit the stacking of the inserts.

9. A Lazy Susan tray insert comprising, in combination:

a Lazy Susan type rotatable tray having a base with a continuous side wall, the base supported by a vertical support post, the side wall having a first height;

at least one removable insert having a substantially wedge-shaped, curved contour and comprising a raised perimeter having a top edge, a bottom edge and a continuous side edge, the side edge having a second height slightly greater than the first height, the insert removably engaging the base, the support post, and the tray side wall;

a lid removably attached to the insert perimeter, the lid conforming to the size and dimensions of the perimeter;

a shelf slightly wider and longer than the insert and having the same shape as the insert, the shelf comprising:

an upper side;

a lower side; and an identical leg permanently attached to and extending downwardly from each corner of the shelf lower side, each leg slightly longer than the second height of the raise perimeter, wherein the legs permit the stacking of the inserts.

* * * * *